US011680430B2

(12) United States Patent
Rosales

(10) Patent No.: US 11,680,430 B2
(45) Date of Patent: Jun. 20, 2023

(54) LINEAR CINCHING SPINDLE

(71) Applicant: Brose Schließsysteme GmbH & Co. Kommanditgesellschaft, Wuppertal, Wuppertal (DE)

(72) Inventor: David Rosales, Rochester Hills, MI (US)

(73) Assignee: Brose Schließsysteme GmbH & Co. Kommanditgesellschaft, Wuppertal

( * ) Notice: Subject to any disclaimer, the term of this patent is extended or adjusted under 35 U.S.C. 154(b) by 369 days.

(21) Appl. No.: 16/280,450

(22) Filed: Feb. 20, 2019

(65) Prior Publication Data

US 2020/0263457 A1 Aug. 20, 2020

(51) Int. Cl.

| | |
|---|---|
| ***E05B 81/12*** | (2014.01) |
| ***E05B 79/20*** | (2014.01) |
| ***E05B 81/20*** | (2014.01) |

(52) U.S. Cl.

CPC ..... *E05B 81/13* (2013.01); *E05B 79/20* (2013.01); *E05B 81/20* (2013.01); *E05Y 2900/546* (2013.01)

(58) Field of Classification Search

CPC ..... E05F 15/611; E05B 79/20; E05B 81/13; E06B 81/13

See application file for complete search history.

(56) References Cited

U.S. PATENT DOCUMENTS

| | | | | |
|---|---|---|---|---|
| 3,343,303 A * | 9/1967 | Bert | E05B 81/20 | 49/280 |
| 3,398,484 A * | 8/1968 | Katsumura | E05F 15/611 | 49/138 |
| 4,333,269 A * | 6/1982 | Bascou | E05F 15/619 | 49/280 |
| 4,530,185 A * | 7/1985 | Moriya | E05B 81/20 | 49/280 |
| 4,739,585 A * | 4/1988 | Pickles | B60J 7/0573 | 49/280 |
| 4,869,537 A * | 9/1989 | Compeau | E05B 81/22 | 292/341.18 |
| 6,075,298 A * | 6/2000 | Maue | B60S 1/166 | 310/112 |
| 6,572,157 B2 * | 6/2003 | Kaute | B60J 7/198 | 292/201 |
| 7,891,138 B2 * | 2/2011 | Ottino | E05B 81/25 | 49/503 |
| 9,376,850 B2 * | 6/2016 | Suzuki | E05F 1/105 | |

(Continued)

FOREIGN PATENT DOCUMENTS

| | | |
|---|---|---|
| DE | 102005060206 A1 | 8/2007 |
| DE | 202007011931 U1 | 1/2009 |

*Primary Examiner* — Gregory J Strimbu

(74) *Attorney, Agent, or Firm* — Dickinson Wright PLLC

(57) ABSTRACT

A linear drive assembly for use with a vehicle including a vehicle body and a closure. The linear drive assembly may include a stationary portion and a translating portion. The translating portion may include a first end portion and a second end portion. The first end portion may be configured to pivot and translate about a vehicle attachment member. The second end portion may be configured to pivot and translate about a closure attachment member and be coupled to a cable operatively coupled to an actuator. When the second end translates about the closure attachment member, the cable may be pulled to actuate the actuator.

12 Claims, 5 Drawing Sheets

(56) References Cited

U.S. PATENT DOCUMENTS

| | | | | |
|---|---|---|---|---|
| 9,677,318 | B2 | 6/2017 | Rosales et al. | |
| 10,801,236 | B2 * | 10/2020 | Rosales | B60J 5/107 |
| 2001/0042998 | A1 * | 11/2001 | Kaute | E05B 81/10 296/190.05 |
| 2009/0217596 | A1 * | 9/2009 | Neundorf | E05B 81/20 49/506 |
| 2011/0175375 | A1 | 7/2011 | Terhaar et al. | |
| 2017/0089112 | A1 * | 3/2017 | Rosales | E05B 79/20 |
| 2017/0145727 | A1 * | 5/2017 | Yamagata | E05F 15/611 |
| 2019/0169886 | A1 | 6/2019 | Rosales | |
| 2020/0123816 | A1 | 4/2020 | Taylor et al. | |

* cited by examiner

LINEAR CINCHING SPINDLE

TECHNICAL FIELD

The present disclosure relates to systems for vehicle closures.

BACKGROUND

Vehicles may include one or more closures, such as, hatches, doors, tailgates, or liftgates. Certain closures may close automatically, e.g. without the assistance of an operator. Vehicles generally include a seal or other type of weather proofing barrier positioned between the closure and the vehicle body to mitigate external elements such as moisture, precipitation, dirt, debris, and noise from entering the interior of the vehicle. The force applied to the closure must be sufficient to overcome pressure associated with the closure and the seal.

SUMMARY

According to one embodiment, a vehicle closure system for use with a closure pivotally coupled to a vehicle body is provided. The vehicle closure system may include a latch, a cable, and a linear drive. The latch may be fixed to the closure or the vehicle body and be configured to change between a first state and a second state. The cable may include a first end and a second end that may be operatively connected to the latch. The linear drive may include a first end configured to be coupled to the vehicle body at a pivot member and a second end that may be provided with a socket. The socket may engage the first end of the cable and be configured to engage an engagement member extending from the closure. The linear drive may be configured to translate the socket with respect to the engagement member to pull the cable to change the latch from the first state to the second state.

The first state may be a secondary latch state and the second state may be a primary latch state. Changing the state of the latch from the first state to the second state may move the closure from a partially closed position to a fully closed position.

The socket may define a receptacle and a channel. The receptacle may be configured to detachably fix the engagement member to a portion of the socket and the channel may be configured to translate about the engagement member.

When the linear drive moves the closure between an open position and the partially closed position, the receptacle may be detachably fixed to the engagement member.

The socket may include a body and an enclosure fixed to the same. The enclosure may be configured to position the body with respect to the engagement member. The enclosure may have an arcuate shape configured to receive a ball of the engagement member.

The enclosure may include an engagement tab that may extend into the receptacle.

The linear drive may be configured to generate a force vector to move the closure. The engagement tab may be configured to transfer the force vector from the linear drive to the engagement member when the closure is moved between the open position and the partially closed position.

According to another embodiment, a vehicle closure system for use with a closure pivotally coupled to a vehicle body is provided. The closure system may include a latch that may be fixed to the closure or the vehicle body. The latch may be configured to actuate to move the closure from a partially closed position to a fully closed position. A cable including a first end and a second end operatively coupled to the latch may be provided. A linear drive may be disposed between the closure and the vehicle body. The linear drive may include a stationary portion and a translating portion that may be coupled to the first end of the cable. The translating portion may be configured to translate along a longitudinal axis with respect to the stationary portion to pull the cable substantially along the longitudinal axis to actuate the latch to move the closure from the partially closed position to the fully closed position.

The translating portion may be configured to translate along the longitudinal axis by a first distance to move the closure between an open position and the partially closed position. The translating portion may be configured to translate along the longitudinal axis by a second distance to actuate the latch.

An engagement member may extend from the closure and when the translating portion translates along the longitudinal axis, a first end of the translating portion may translate about the engagement member.

The closure may be pivotally coupled to the vehicle body at a closure pivot point. A closure angle may be defined between the longitudinal axis and a plane extending between the closure pivot point and the engagement member. When the closure angle is less than or equal to a predetermined closure angle, the first end of the translating portion may translate about the engagement member.

The engagement member may include a base and ball extending therefrom. The first end of the linear drive may include a socket that may define a receptacle that engages the ball when the closure angle is greater than the predetermined closure angle.

When the closure is in the partially closed position, the closure angle may be less than or equal to the predetermined closure angle.

According to yet another embodiment, a linear drive assembly for use with a vehicle including a vehicle body and a closure is provided. The linear drive assembly may include a stationary portion and a translating portion. The translating portion may include a first end portion and a second end portion. The first end portion may be configured to pivot and translate about a vehicle attachment member. The second end portion may be configured to pivot and translate about a closure attachment member and be coupled to a cable operatively coupled to an actuator. When the second end translates about the closure attachment member, the cable may be pulled to actuate the actuator.

The actuator may be a latch configured to move the closure from a partially closed position to a fully closed position as the cable is pulled by a first predetermined distance.

The second end portion may be configured to translate about the vehicle attachment member by a second predetermined distance. The first predetermined distance may be based on the second predetermined distance.

The first end portion may be configured to translate about the vehicle attachment member by a third predetermined distance. The third predetermined distance may be equal to or less than the second predetermined distance.

The translating portion may include a first rod that includes the first end portion, a second rod that includes the second end portion, and a motor configured to extend and retract the first and second rods with respect to the stationary portion. The first end portion may translate about the vehicle attachment member when the first rod retracts.

The first end portion may define a receptacle and a channel. When the first end portion pivots about the vehicle attachment member the receptacle engages the vehicle attachment member and wherein the channel translates about the vehicle attachment member.

DETAILED DESCRIPTION

Figure 1:
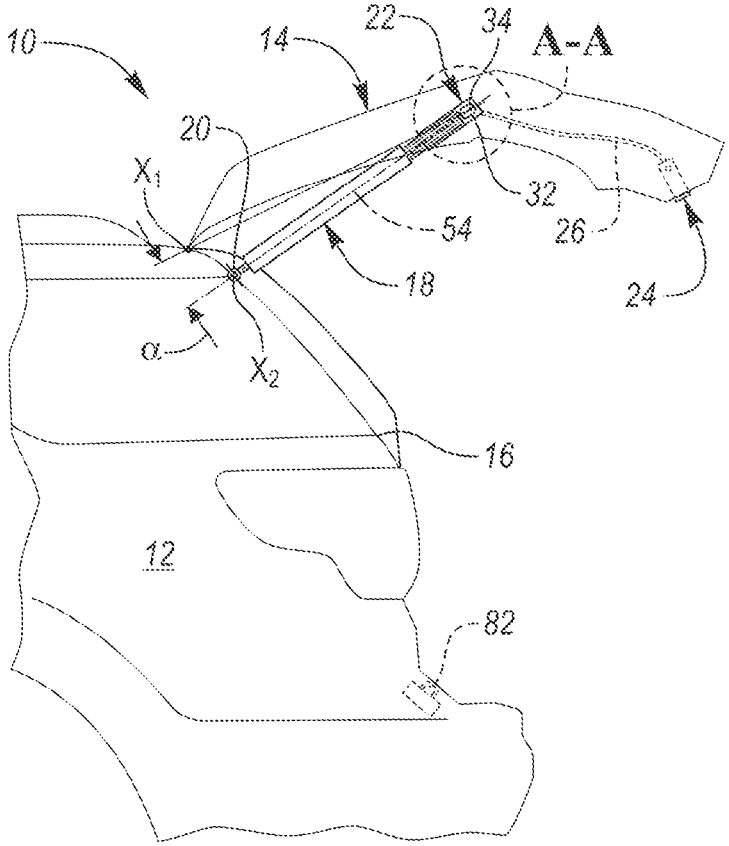
FIG. 1 is a partial-plan view of an exemplary vehicle that includes an exemplary closure in an open position.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

The term "secondary state" or "secondary position" may be used herein to describe disclosed or claimed embodiments. The term "secondary state" or "secondary position" means the catch or pawl is engaged e.g., in contact with the striker, but a secondary lock is not engaged. Alternatively, the term secondary state means the closure is in a partially closed position and has not overcome the pressure of the seal to move to the fully closed position.

The term "primary state" or "primary position" may be used herein to describe disclosed or claimed embodiments. The term "primary state" or "primary position" means the latch has moved from the secondary state to pull the closure to overcome the seal into a fully closed position.

A cinching system may be employed to pull the closure from a secondary latching position to a primary latching position, thereby overcoming the pressure of the seal and ensuring automatic closing of the closure. For example, U.S. Pat. No. 9,677,318 discloses one example of a cinching system and is hereby incorporated by reference in its entirety.

As another example, U.S. application Ser. No. 15/828,879 discloses a transfer element, such as a lever, that exerts a pulling force to a catch to move from the secondary latch position to a primary latch position and is hereby incorporated by reference in its entirety. One disadvantage of the transfer element is the space required to facilitate rotational movement of the lever. Another disadvantage of the transfer element is that actuating the transfer element requires a varying force to move from the secondary latch position to a primary latch position.

As yet another example, U.S. application Ser. No. 16/165,122 discloses a fixed member connected to a vehicle closure and a slide coupled to a second end of a linear drive and is hereby incorporated by reference in its entirety. The slide may be configured to move between a deployed position, when the vehicle closure is in the open position, and a retracted position, when the vehicle closure is in a closed position. A cable may be operatively connected between the slide and the latch so that when the slide moves from the retracted position to the deployed position the latch moves from the secondary latch position to the primary latch position.

Figure 7:
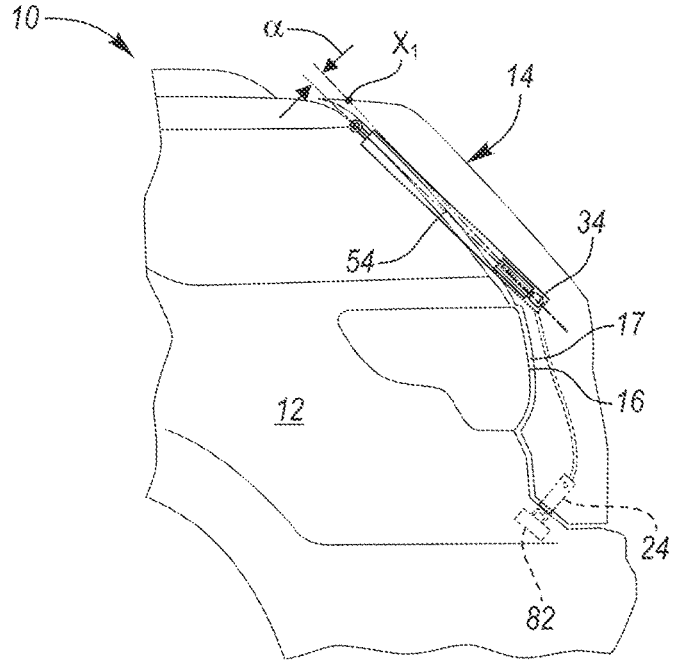
FIG. 7 is a partial-plan view of an exemplary vehicle that includes an exemplary closure in a partially closed position.
Figure 8:
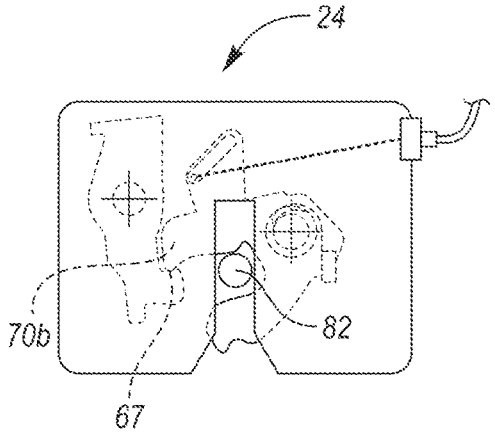
FIG. 8 is a detailed view of an exemplary latch in a secondary state or secondary position.
Figure 9:
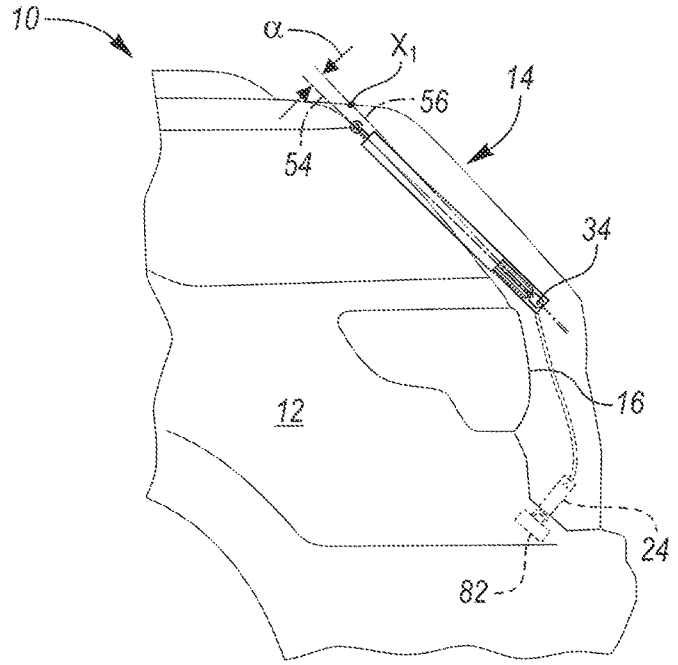
FIG. 9 is a partial-plan view of an exemplary vehicle that includes an exemplary closure in a fully closed position.

With reference to FIG. 1 through FIG. 11, a vehicle 10 provided with a vehicle body 12 and a vehicle panel, such as a hatch, door, tailgate, liftgate, or closure 14 pivotally attached to the vehicle body. The closure 14 may move from an open position (FIG. 1) to a partially closed position (FIG. 7), to a closed position (FIG. 9). In partially closed and closed positions, the closure 14 covers or closes one or more openings 16 defined by the vehicle body. In one or more embodiments, "partially closed" refers to the closure 14 being adjacent to the vehicle body 12 but not sealed. In one or more embodiments, the term "fully closed" refers to a closure 14 moved into a sealed position. The term sealed means the closure 14 has overcome a pressure associated with the seal of the vehicle 10.

The vehicle 10 includes a vehicle closure system that may include but is not limited to a drive arrangement, such as a spindle drive, spindle assembly, or linear drive 18. The linear drive 18 may include a first end or end portion 20 that may be attached (e.g., pivotally) to the vehicle body 12 at point $X_2$. The linear drive 18 may include a second end or end portion 22 that may be coupled, directly or indirectly, to the closure 14.

Figure 10:
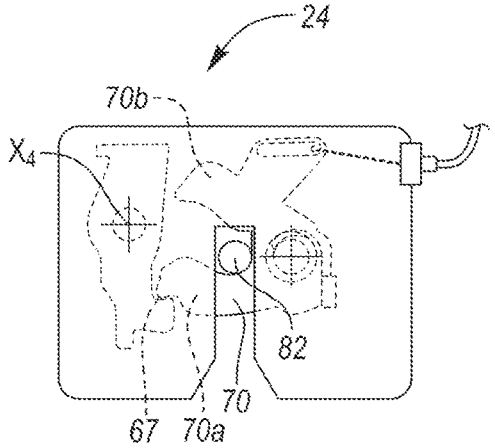
FIG. 10 is a detailed view of an exemplary latch in a primary state, or primary position or fully-cinched state.
Figure 11A:
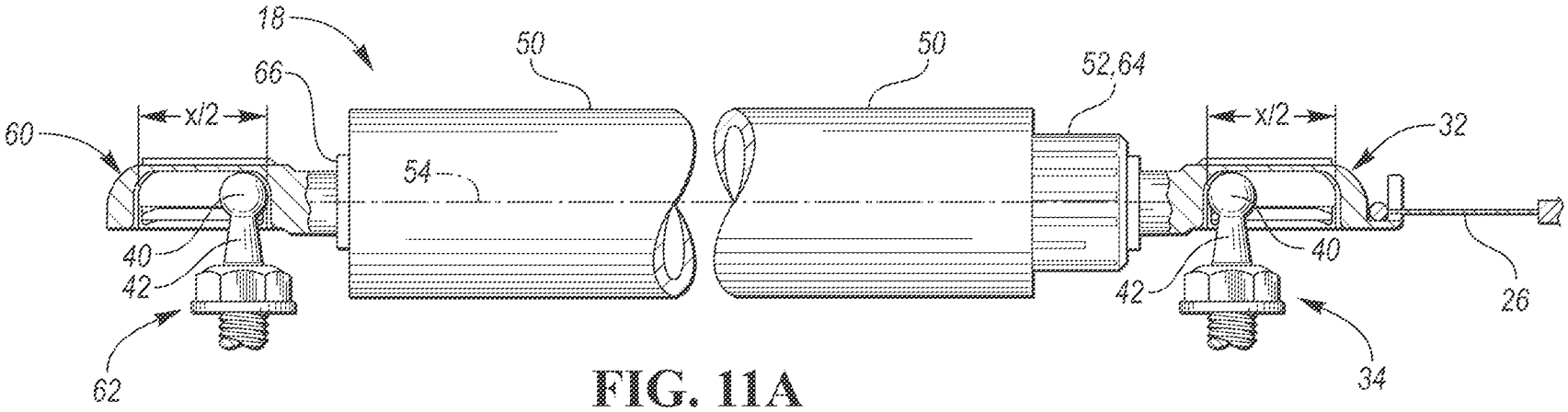
FIG. 11A is a fragmented and partial-cross-sectional view of a first end and a second end of the linear drive assembly in one or more positions.
Figure 11B:
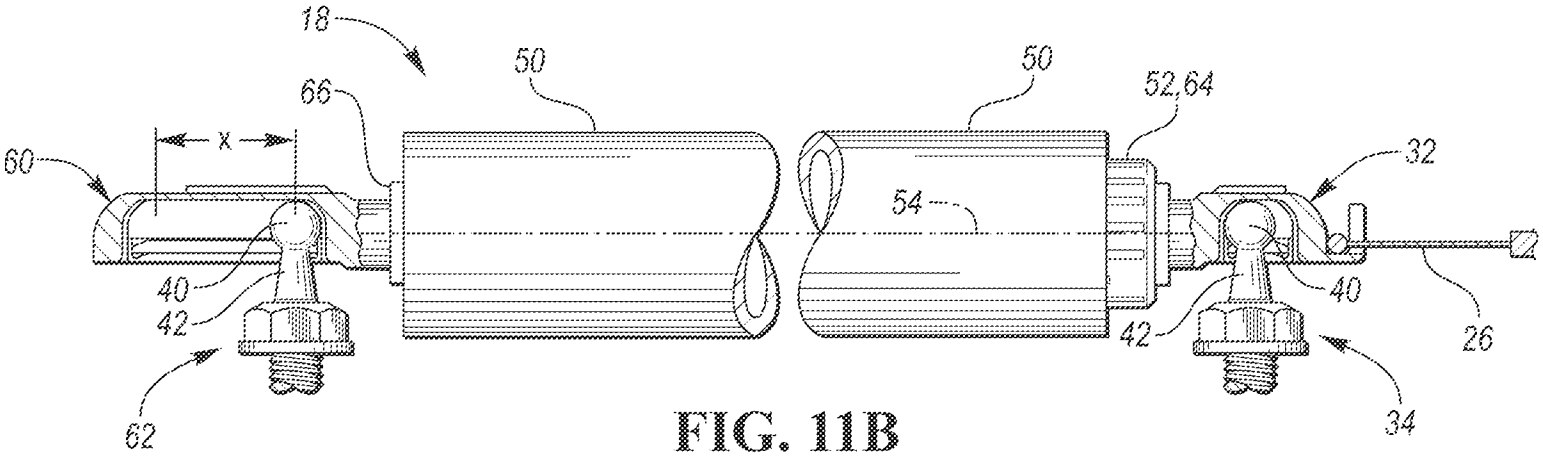
FIG. 11B is a fragmented and partial-cross-sectional view of a first end and a second end of the linear drive assembly in one or more positions.

A latch 24 may be fixed to either the closure 14 or the vehicle body 12. The latch 24 may be configured to change between a first state, for example, an open state (FIG. 2), secondary state (FIG. 8), and a primary state (FIG. 10). A cable 26 may include a first end 28 and a second end 30 that may be operatively connected to the latch 24. The first end 28 of the cable 26 may engage a socket 32 provided on the second end 22 of the linear drive 18. The socket 32 may be configured to engage an engagement member 34 that may extend from the closure 14. The linear drive 18 may be configured to translate the socket 32 with respect to the engagement member 34 to pull the cable to change the latch from a first state, e.g., secondary state to a second state e.g., primary state.

The socket 32 may define a receptacle 36 and a channel 38 that may extend therefrom. The receptacle 36 may be configured to detachably fix a portion of the engagement member 34, such as a ball 40, to a portion of the socket 32 when the closure moves between or is positioned between the open position and the partially closed position. The channel 38 may translate with respect to another portion of the engagement member 34, such as, a base 42 to pull the cable to change the state of the latch.

The socket 32 may include an enclosure 44 that may be fixed to a body 46 of the socket 32. The enclosure may have an arcuate shape and act as a stop against the engagement member 34 to position the body 46 of the socket 32 with respect to the engagement member 34 and closure 14. In one or more embodiments, the enclosure may include one or more engagement tabs 48 that extend into the receptacle 36 to engage the engagement member 34. As the linear drive 18 actuates to move the closure between the open and partially closed positions, a force vector 49 may be exerted from the linear drive 18 through the engagement tab 48 to the engagement member 34.

In one or more embodiments, the latch 24 may be configured to move the closure 14 from the partially closed position to the fully closed position. The linear drive 18 may include a stationary portion 50 and a translating portion 52 that may translate along a longitudinal axis 54. The translating portion 52 may be coupled e.g. directly or indirectly to the cable 26 so that as the translating portion 52 of the linear drive 18 translates, the cable 26 is pulled substantially along the longitudinal axis 54 to actuate the latch 24. Pulling the cable 26 along the longitudinal axis 54 may provide certain advantages over pulling a cable that is offset from the longitudinal axis 54. For example, applying the force in such a colinear manner may mitigate twisting or bending moments associated with applying the force to the cable in a non-colinear manner.

The translating portion 52 may be translated along the longitudinal axis 54 by a first distance to move the closure 14 from the open position to the partially closed position. And the translating portion may be configured to translate by a second distance that may be less than the first distance, to actuate the latch 24.

A closure angle $\alpha$ may be defined by the longitudinal axis 54 and a plane 56 that extends between the closure pivot point $X_1$ and the engagement member 34 extending from the closure 14. When the closure angle $\alpha$ is less than a predetermined closure angle, a portion of the socket 32, such as the channel 38 may be arranged with respect to the linear drive 18 so that the channel 38 may translate along the engagement member 34 when the translating portion 52 of linear drive 18 retracts. When the closure angle $\alpha$ is greater than the predetermined closure angle, such as when the closure 14 moves from the partially closed position to the open position, a portion of the socket 32, such as the receptacle 36 may be arranged with respect to the linear drive 18 so that the receptacle 36 of socket 32 and linear drive 18 pivots or rotates about the engagement member 34.

In one or more embodiments, the linear drive 18 may include a first end portion, such as a vehicle-side socket 60 that may be configured to pivot and translate about a vehicle attachment member 62. The vehicle-side socket 60 may be independent of or in combination with the socket 32 configured to translate and pivot about the engagement member 34 extending from the closure 14 (herein after referred to as the closure-side socket 32). The linear drive 18 may include a first translating member 64 that includes the closure-side socket 32 and a second translating member 66 that includes the vehicle-side socket 60. The first and second translating members 66, 64 may be extended or retracted simultaneously by a motor, or spring, (not shown) or some combination thereof.

The vehicle-side socket 60 may decrease the distance required for pulling the cable 26 to actuate the latch. For example, if the distance required for pulling the cable 26 is X, the vehicle-side socket 60 may retract by half the distance or distance $$\frac{X}{2}$$

and the closure-side socket xx may retract by have the distance or distance $$\frac{X}{2}.$$

Distributing the distance translated between the vehicle-side socket 60 and the closure-side socket 32 may decrease the time required to pull the cable 26 to actuate the latch 24.

Figure 2:
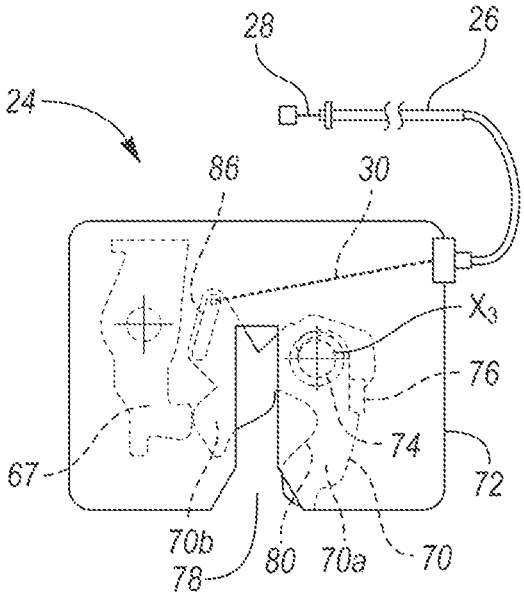
FIG. 2 is a detailed view of an exemplary latch in an open state or open position.
Figure 3:
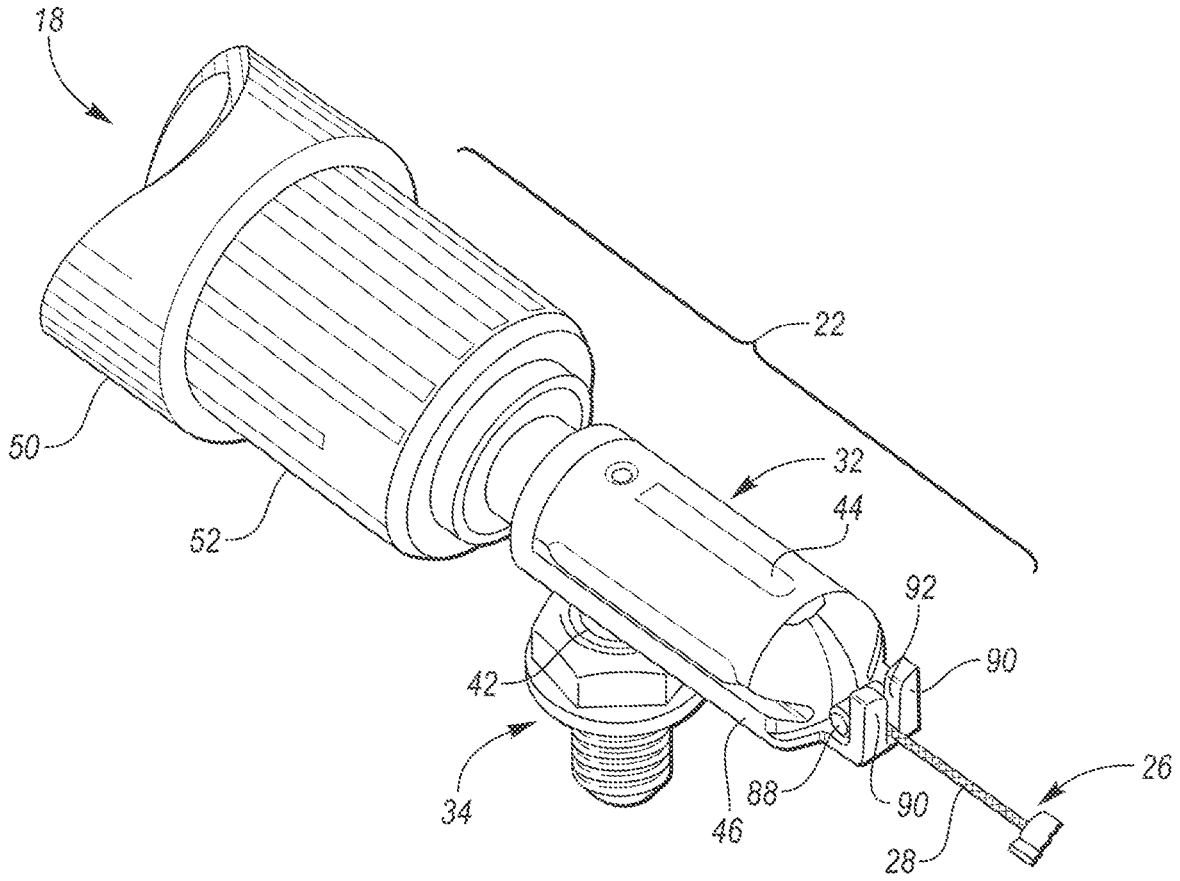
FIG. 3 is a partial-perspective view of an exemplary linear drive assembly taken along the lines A-A in FIG. 1.

Referring specifically to FIG. 2, a plan view of the latch 24 in the open or disengaged state or position is illustrated. The latch 24 may include a catch 70 that may be disposed within a housing 72 and pivotable about a fastener 74 that defines a pivot axis $X_3$. The catch 70 may be biased or constrained by an elastic member such as a spring 76 that biases a first arm 70*a* of the catch 70 away from the opening 78. A second arm 70*b* of the catch 70 may define a primary engaging surface 80, that may engage a striker 82 (FIG. 1) when in the primary latch state. An end 30 of the cable 26 may engage a slot such as an elongated slot 86 that is defined by the catch 70. As shown in FIG. 3, the socket 32 and the translating portion 52 are in an extended position, thus the catch 70 is biased by the spring 76 to the open position.

Referring specifically to FIG. 3, a perspective view of the linear drive 18, socket 32, and cable 26 fixed to the socket 32 is illustrated. As previously described, the socket 32 may include a body 46 and an enclosure 44 that is fixed to the body. In one or more embodiments, the body 46 may be formed of a metal material or alloy and the enclosure 44 may be formed of a plastic or polymeric material. As another example, the enclosure may be formed of a metal material, such as spring steel. During the assembly of the socket 32 to the engagement member 34, the receptacle 36 defined by the body 46 may be positioned on to the ball 40 of the engagement member 34 and the enclosure 44 may be fixed to the body 46 to engage the ball 40.

The body 46 may define a cable fixation portion that is configured to engage an end 88 of the cable 26. As one example, the body 46 may include a pair of arms 90 that define an opening 92. The cable 26 may be disposed between the pair of arms 90 so that the end 88 of the cable 26 engage the pair of arms 90.

Figure 4:
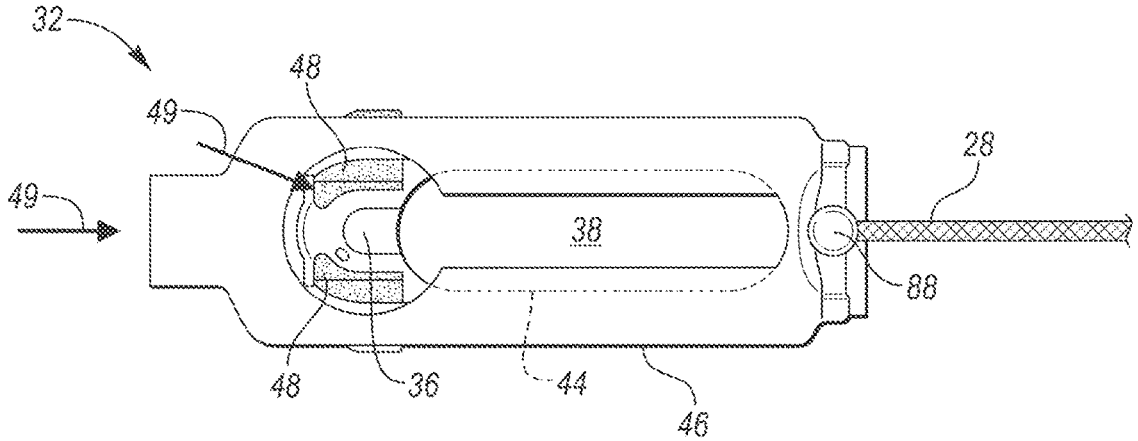
FIG. 4 is a partial-bottom view of an exemplary end portion or socket of the linear drive assembly.

Referring specifically to FIG. 4, a bottom view of the socket 32 and the cable 26 is illustrated. As previously described, the enclosure 44 may include one or more engagement tabs 48 that extend into the receptacle 36 to engage the engagement member 34, or more specifically the ball 40 of the engagement member 34. Here, the end 88 of the cable 26 may be positioned orthogonally from the position of the end 88 of the cable 26 illustrated in FIG. 3.

In one or more embodiments, body 46 may be a component made by metal casting or other suitable processes so that the receptacle 36 and the channel 38 is defined. As another example, the receptacle and channel may be machined from a block of material.

Figure 5:
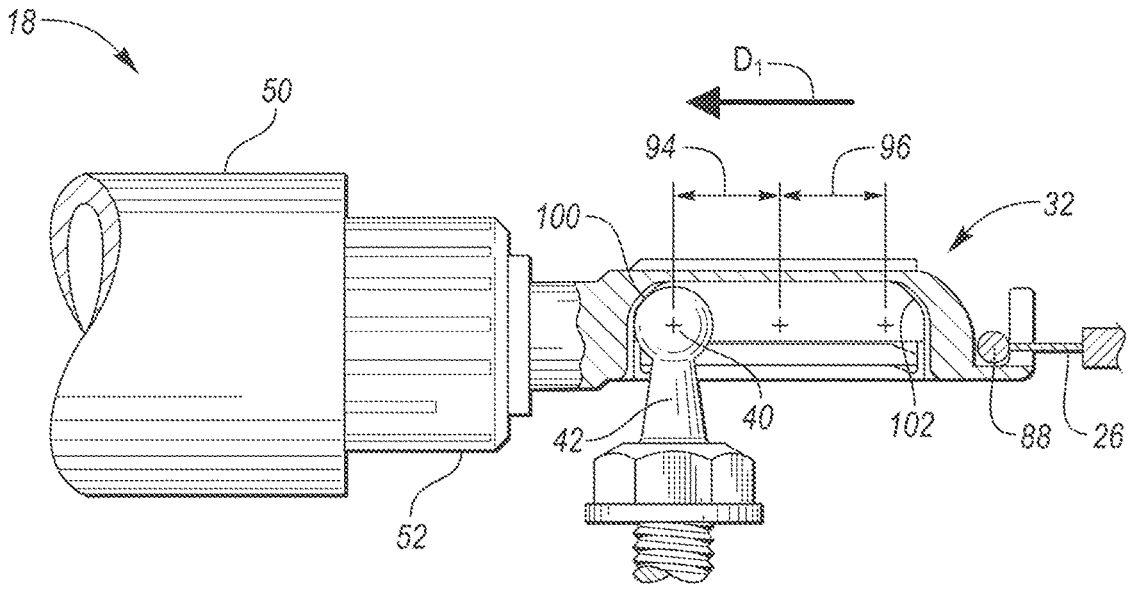
FIG. 5 is a partial-cross sectional view of an exemplary linear drive assembly in an extended position.

Referring specifically to FIG. 5, a partial-cross sectional view of the linear drive 18, socket 32, and the cable 26 is illustrated. As illustrated, the translating portion 52 is positioned in the extended position and the ball 40 is disposed near or adjacent to a rear portion 100 of the socket 32. When the ball 40 is disposed in or near the rear portion 100 of the socket 32, the ball 40 is detachably fixed to the receptacle 36. As the translating portion 52 retracts, the socket 32 may move by distance 94 so that the cable 26 is at least partially pulled. When the cable 26 is partially pulled the state of the latch 24 may begin to change from the secondary state. As the translating portion 52 retracts further by distance 96, the cable may be pulled further so that the latch 24 changes from the secondary state to the primary state. As the socket 32 moves, the channel 38 translates about the base 42 of the engagement member 34.

Figure 6:
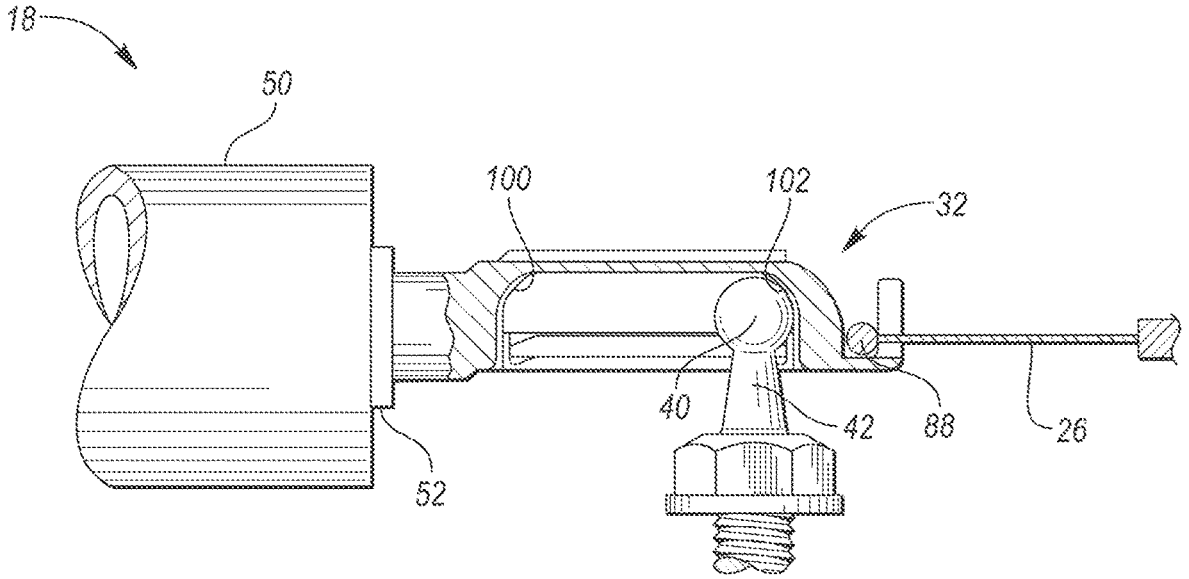
FIG. 6 is a partial-cross sectional view of an exemplary linear drive assembly in a retracted position.

Referring specifically to FIG. 6, a partial-cross sectional view of the linear drive 18, socket 32, and the cable 26 is illustrated. Here the linear drive 18 and the socket 32 is retracted so that the socket 32 moves about the engagement member 34 so that a forward portion 102 of the socket 32 contacts or is adjacent to the engagement member 34.

Referring specifically to FIG. 7, a partial plan view of the vehicle 10 provided with the closure 14 in a partially open position is illustrated. The closure 14 may move from the open position to the partially closed position by actuating the linear drive 18 by an electric motor (not shown), or by disengaging a locking member and allowing the weight of the closure move to the partially closed position, or some combination thereof. As described above, in this position the closure 14 has not overcome the pressure of the seal 17 between the opening 16 and the closure 14. While a visible gap is shown between the closure 14 and the vehicle body 12, this gap is exaggerated for clarity. When the closure is in the partially closed position, the socket 32 may be positioned in a retracted position (FIG. 5).

Referring specifically to FIG. 8, a plan view of the latch 24 in the secondary latch state is illustrated. Here, the second arm 70*b* of the catch may be engaged with a portion of the pawl 67 and the striker 82. The latch 24 may be operatively coupled to a switch (not shown) that may provide a signal to a controller (not shown) to indicate that the latch 24 is in the secondary latch state.

Referring specifically to FIG. 9 and FIG. 10, the closure 14 and latch 24 are each shown in the closed or fully closed position. In this position, the closure 14 may be moved to the closed position by rotating the catch 70 so that a locking surface of the first arm 70*a* of the catch 70 engages the striker 82. In one or more embodiments, the linear drive 18 and the socket 32 may be in the retracted position, as illustrated in FIG. 6.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

PARTS LIST

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

vehicle 10
vehicle body 12
closure 14
opening 16
seal 17
linear drive 18
first end portion 20
second end portion 22
latch 24
cable 26
first end (cable) 28
second end (cable) 30
closure—side socket 32
engagement member 34
receptacle 36
channel 38
ball 40
base 42
enclosure 44
body 46
engagement tab 48
force vector 49
stationary portion 50
translating portion 52
longitudinal axis 54
plane 56
closure pivot point X1
vehicle-side socket 60
vehicle attachment member 62 second translating member 64
pawl 67
catch 70
housing 72
fastener 74
spring 76
opening 78
primary engaging surface 80
striker 82
wire 84
slot 86
end 88
arms 90
opening 92
distance 94
distance 96
rear portion 100
forward portion 102
first arm 70*a*
second arm 70*b*

What is claimed is:

1. A vehicle closure system for use with a closure pivotally coupled to a vehicle body, the vehicle closure system comprising:

a latch, fixed to the closure, and configured to change between a first state and a second state;

a cable including a first end and a second end wherein the second end is operatively connected to the latch; and a linear drive including, a first end configured to be coupled to the vehicle body at a pivot member, and a second end provided with a socket engaged with the first end of the cable, wherein the socket is configured to engage an engagement member extending from the closure, wherein the linear drive is configured to translate the socket with respect to the engagement member to pull the cable to change the latch from the first state to the second state, wherein the first state is a secondary latch state and the second state is a primary latch state, and wherein when the latch is in the secondary latch state, the closure is in a partially closed position, and when the latch is in the primary latch state, the closure is in a fully closed position.

2. The vehicle closure system of claim 1, wherein the socket defines a receptacle and a channel wherein the receptacle is configured to detachably fix the engagement member to a portion of the socket and wherein the channel is configured to translate with respect to the engagement member.

3. The vehicle closure system of claim 2, wherein when the linear drive moves the closure between an open position and the partially closed position, the receptacle is detachably fixed to the engagement member.

4. The vehicle closure system of claim 3, wherein the socket includes a body that defines an enclosure, wherein the enclosure is configured to position the body with respect to the engagement member.

5. The vehicle closure system of claim 4, wherein the enclosure has an arcuate shape configured to receive a ball of the engagement member.

6. The vehicle closure system of claim 4, wherein the enclosure includes an engagement tab, and wherein the engagement tab extends into the receptacle.

7. The vehicle closure system of claim 6, wherein the linear drive is configured to generate a force vector to move the closure and wherein the engagement tab is configured to transfer the force vector from the linear drive to the engagement member when the closure is moved between the open position and the partially closed position.

8. A linear drive assembly for use with a vehicle including a vehicle body and a closure, the linear drive assembly comprising:

a stationary portion; and a translating portion configured to linearly translate with respect to the stationary portion to move the closure between an open position and a partially closed position, the translating portion including, a first end portion including a first socket configured to pivot and translate with respect to a vehicle attachment member fixed to the vehicle body, wherein the first socket defines a receptacle and a channel, and when the first socket translates relative to the vehicle attachment member, the receptacle disengages from the vehicle attachment member and the channel engages the vehicle attachment member, and a second end portion including a second socket configured to pivot and translate with respect to a closure attachment member fixed to the closure, wherein the second socket is configured to be fixed to a cable operatively coupled to a latch, wherein when the second end portion translates with respect to the closure attachment member, the cable is pulled to actuate the latch.

9. The linear drive assembly of claim 8, wherein the latch is configured to move the closure from the partially closed position to a fully closed position as the cable is pulled by a first predetermined distance.

10. The linear drive assembly of claim 9, wherein the second socket is configured to translate with respect to the vehicle attachment member by a second predetermined distance, wherein the first predetermined distance is based on the second predetermined distance.

11. The linear drive assembly of claim 10, wherein the first end portion is configured to translate with respect to the vehicle attachment member by a third predetermined distance, wherein the third predetermined distance is equal to or less than the second predetermined distance.

12. The linear drive assembly of claim 8, wherein the translating portion is provided with a first rod, that includes the first end portion, a second rod that includes the second end portion, wherein the first and second rods are configured to extend and retract from the stationary portion, wherein the first socket translates with respect to the vehicle attachment member when the first rod retracts towards the stationary portion.

* * * * *